US008020858B2

(12) United States Patent
deJong et al.

(10) Patent No.: US 8,020,858 B2
(45) Date of Patent: Sep. 20, 2011

(54) ACCURATE SHEET LEADING EDGE REGISTRATION SYSTEM AND METHOD

(75) Inventors: Joannes N.M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 103 days.

(21) Appl. No.: 12/474,377

(22) Filed: May 29, 2009

(65) Prior Publication Data

US 2010/0301545 A1 Dec. 2, 2010

(51) Int. Cl.
*B65H 7/02* (2006.01)

(52) U.S. Cl. ..... 271/228; 271/227

(58) Field of Classification Search ..... 271/227, 271/228

See application file for complete search history.

(56) References Cited

U.S. PATENT DOCUMENTS 5,094,442 A 3/1992 Kamprath et al.
5,219,159 A * 6/1993 Malachowski et al. ..... 271/228
5,278,624 A * 1/1994 Kamprath et al. ..... 399/395
5,887,996 A * 3/1999 Castelli et al. ..... 400/579
6,533,268 B2 3/2003 Williams et al.
6,575,458 B2 6/2003 Williams et al.
6,578,844 B2 * 6/2003 Acquaviva et al. ..... 271/228
7,319,842 B2 * 1/2008 Koyanagi et al. ..... 399/395
7,422,211 B2 9/2008 Dejong et al.
7,753,370 B2 * 7/2010 Inoue ..... 271/239
2008/0193148 A1 8/2008 Bonino
2009/0020941 A1 1/2009 deJong et al.

* cited by examiner

*Primary Examiner* — Stefanos Karmis
*Assistant Examiner* — Ernesto Suarez
(74) *Attorney, Agent, or Firm* — Hoffmann & Baron, LLP

(57) ABSTRACT

Accurate sheet leading edge registration system and method including a first and second nip assembly, a first sheet leading edge sensor and a controller. The first and second nip assemblies being spaced apart from one another. The first sheet leading edge sensor capable of detecting an arrival of a leading edge of a sheet at a point in the process direction. The arrival being associated with engagement of the first and second nip assemblies with the sheet. The controller capable of imparting a rotational skew velocity to the sheet using the first and second nip assemblies. A center of rotation of the skew velocity being offset laterally from a center of the sheet leading edge. The method includes providing at least the above-mentioned nip assemblies, first sheet leading edge sensor and controller.

8 Claims, 5 Drawing Sheets

ACCURATE SHEET LEADING EDGE REGISTRATION SYSTEM AND METHOD

TECHNICAL FIELD

The presently disclosed technologies are directed to a system for and a method of accurately registering the leading edge of a sheet in a media handling assembly, such as a printing system.

BACKGROUND

In media handling assemblies, particularly in printing systems, accurate and reliable registration of the substrate media as it is transferred in a process direction is desirable. In particular, accurate registration of the substrate media, such as a sheet of paper, as it is delivered at a target time to an image transfer zone will improve the overall printing process. The substrate media is generally conveyed within the system in a process direction. However, often the substrate media can shift in a cross-process direction that is lateral to the process direction or even acquire and angular orientation, referred herein as "skew," such that it's opposed linear edges are no longer parallel to the process direction. Thus, there are three degrees of freedom in which the substrate media can move, which need to be controlled in order to achieve accurate delivery thereof. A slight skew, lateral misalignment or error in the arrival time of the substrate media through a critical processing phase can lead to errors, such as image and/or color registration errors relating to arrival at an image transfer zone. Also, as the substrate media is transferred between sections of the media handling assembly, the amount of skew can increase or accumulate. A substantial skew can cause pushing, pulling or shearing forces to be generated, which can wrinkle, buckle or even tear the sheet.

Contemporary systems transport a sheet and deliver it at a target time to a "datum," based on measurements from the sheet leading edge. The datum can be a particular point in a transfer zone, a hand-off point to a downstream nip assembly or any other target location within the media handling assembly. Typically, the time of arrival of the sheet leading edge into a sheet registration system is measured by sensors located near the input of the registration system. A controller then computes a sheet velocity command profile designed to deliver the sheet at the target time to a predesignated datum. A sheet velocity actuator commanded by the controller then executes a command profile in order to timely deliver the sheet. Examples of typical sheet registration and deskewing systems are disclosed in U.S. Pat. Nos. 5,094,442, 6,533,268, 6,575,458 and 7,422,211, commonly assigned to the assignee of record herein, namely Xerox Corporation, the disclosures of which are each incorporated herein by reference. While these systems particularly relate to printing systems, similar paper handling techniques apply to other media handling assemblies.

Such contemporary systems attempt to achieve position registration of sheets by separately varying the speeds of spaced apart drive rollers to correct for skew mispositioning of the sheet, which is also referred to as differentially driven drive or nip assemblies. FIG. 4 shows the sheet registration system 8 from U.S. Pat. No. 5,094,442, which consists of two sets of drive nip assemblies 20, 30. As commonly referred to in the media handling art, each nip assembly 20, 30 includes a driven wheel 22, 24 (also referred to as drive rolls) and an idler wheel 26, 28, (also referred to as idler rolls) which together engage opposed sides of the sheet S and conveying it within the printing system in a process direction P. Also, included are separate drive motors and/or belt assemblies 21, 23 for imparting an angular velocity to the driven wheels 22, 24. While the motor may be connected directly to the driven wheels 22, 24, belts 21, 23, also referred to as timing belts, are often employed. Also, the motors may be stepper motors or DC servo motors with encoder feedback from an encoder mounted on the motor shaft, a driven wheel shaft or the idler shaft 25. The registration system 8 also includes sheet leading edge sensors 48, 50, which are used to detect the arrival of a sheet. The sequence of arrival at each individual sensor 48, 50 is also used to measure rotational mispositioning (skew) of the sheet. Temporarily driving two motors at slightly different rotational speeds provides a slight difference in the total rotation or relative pitch position of each drive roll 22, 24 while the sheet is held in the two nips 20, 30. That moves one side of the sheet ahead of the other to induce a skew (small partial rotation) in the sheet, opposite from an initially detected sheet skew in order to eliminate and correct for the detected skew.

FIG. 5 shows the sheet registration system 9 from U.S. Pat. No. 7,422,211, which also includes two spaced apart nip assemblies 20, 30 and a common idler shaft 25. As above, paper skew is corrected by a controller 60 prescribing differentially driven nips 20, 30 for a short period of time while the sheet S is engaged by the nips 20, 30. The sheet arrive time and skew are measured by sensors 48, 50 that are disposed along sensor line 41 that extends perpendicular to the process direction P. In such contemporary systems, while the nip velocities are varied, the average velocity between both nips must always equal the desired forward velocity of the sheet in order to maintain process speeds. In this way, both nip velocities deviate for a short period of time from the desired process speeds by the same amount, one being greater than the process speed and the other being less than the process speed by an equal amount. Also, the difference between the nip velocities will temporarily impart an angular velocity to the sheet used to correct skew. Thus, the resultant rotation of the sheet is always laterally positioned in the exact center between the two nip assemblies 20, 30. However, the position of that center of rotation is different from the lateral and process positions of either sensor used to detect the leading edge time of arrival. It is the leading edge time of arrive that is generally used, in conjunction with the registration distance D, to time the delivery of the sheet to the registration datum 100. In fact, when the sheet S is skewed one of the two sensors 48, 50 will detect the sheet S before the other. It is that first sensor time of arrival uses to time the arrival of the sheet S at the datum 100. However, the center of rotation, which becomes the corrected leading edge position after de-skewing, lags behind the initially detected leading edge. Accordingly, an error in the leading edge arrival time at the registration datum 100 is inherently introduced in such contemporary systems, unless the skew profile is known and further calculations are done to correct for the error. Also, such systems use a pair of symmetrically spaced leading edge sensors, which is limiting on the design configuration for print registration systems.

Accordingly, it would be desirable to provide a system for and method of accurately registering the leading edge of a sheet in a media handling assembly, which overcomes the shortcoming of the prior art.

SUMMARY

According to aspects described herein, there is disclosed a system for registering the leading edge of a sheet moved substantially in a process direction along a path in a media handling assembly. A lateral direction is defined as extending perpendicular to the process direction. The system includes a first and second nip assembly, a first sheet leading edge sensor and a controller. The first and second nip assemblies being spaced apart from one another. The first sheet leading edge sensor capable of detecting an arrival of a leading edge of a sheet at a point in the process direction. The arrival being associated with engagement of the first and second nip assemblies with the sheet. The controller capable of imparting a rotational skew velocity to the sheet using the first and second nip assemblies. A center of rotation of the skew velocity being offset laterally from a center of the sheet leading edge.

Additionally, the skew velocity center of rotation can be coincident with a lateral position of the first sheet leading edge sensor. The first sheet leading edge sensor can be spaced away from at least one of the first and second nip assemblies by a sensor offset distance. The offset distance extending laterally. Also, the rotational skew velocity can be generated by changing a sheet driving velocity of each of the first and second nip assemblies, the sheet driving velocities can be calculated in accordance with:

$$\delta V_i=(1+\alpha)V_{skew}; \text{ and}$$

$$\delta V_o=\alpha V_{Skew},$$

wherein $\delta V_i$ represents the change in sheet drive velocity of the first nip assembly, $\delta V_o$ represents the change in sheet drive velocity of the second nip assembly, $V_{Skew}$ represents a rotational velocity imparted on the sheet, and a represents a ratio of a lateral sensor offset distance between the first sheet leading edge sensor and the nearest of the first and second nip assemblies, over a lateral nip assembly spacing. Further, the skew velocity center of rotation can be coincident with a lateral position of a virtual point, the virtual point lateral position being offset from a lateral position of the first sheet leading edge sensor.

Further, a second sheet leading edge sensor can be provided laterally spaced from the first sheet leading edge sensor. The skew velocity center of rotation can be coincident with a lateral position of a virtual point, the virtual point lateral position being offset from a lateral position of both the first and second sheet leading edge sensors. The virtual point lateral position can also be determined based upon which of the first and second sheet leading edge sensors initially detected the leading edge of the sheet. A differential drive system operatively can be connected to the first nip assembly, the second nip assembly and the controller, with the differential drive system inducing the rotational skew velocity to the sheet. Additionally, a cross-process sheet adjustment assembly can be provided for laterally moving said sheet while engaged by the first and second nip assemblies. The cross-process sheet adjustment assembly can include a carriage for laterally moving said first and second nip assemblies.

According to other aspects described herein, there is provided method of registering the leading edge of a sheet moved substantially in a process direction along a path in a media handling assembly. A lateral direction extending perpendicular to the process direction. The method including providing a first nip assembly and a second nip assembly. The first and second nip assemblies being spaced apart from one another. The method further providing a first sheet leading edge sensor. The first sheet leading edge sensor capable of detecting an arrival of a leading edge of a sheet at a point in the process direction. The arrival being associated with engagement of the first and second nip assemblies with the sheet. The method also including imparting a rotational skew velocity to the sheet using the first and second nip assemblies. A center of rotation of the skew velocity being offset laterally from a center of the sheet leading edge.

Additionally, the method can further include providing the first leading edge sensor wherein the sensor is spaced away from at least one of the first and second nip assemblies by a sensor offset distance. The offset distance extending laterally. Also, the method can include providing a second sheet leading edge sensor laterally spaced from the first sheet leading edge sensor. The skew velocity center of rotation can be coincident with a lateral position of a virtual point. Also, the virtual point lateral position can be offset from a lateral position of both the first and second sheet leading edge sensors. The virtual point lateral position can be determined based upon which of the first and second sheet leading edge sensors initially detected the leading edge of the sheet. The method can further include providing a differential drive system operatively connected to the first nip assembly, the second nip assembly and the controller. The differential drive system inducing the rotational skew velocity to the sheet. Also, the method can include providing a cross-process sheet adjustment assembly for laterally moving said sheet. Further the cross-process sheet adjustment assembly can include a carriage for laterally moving said first and second nip assemblies.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
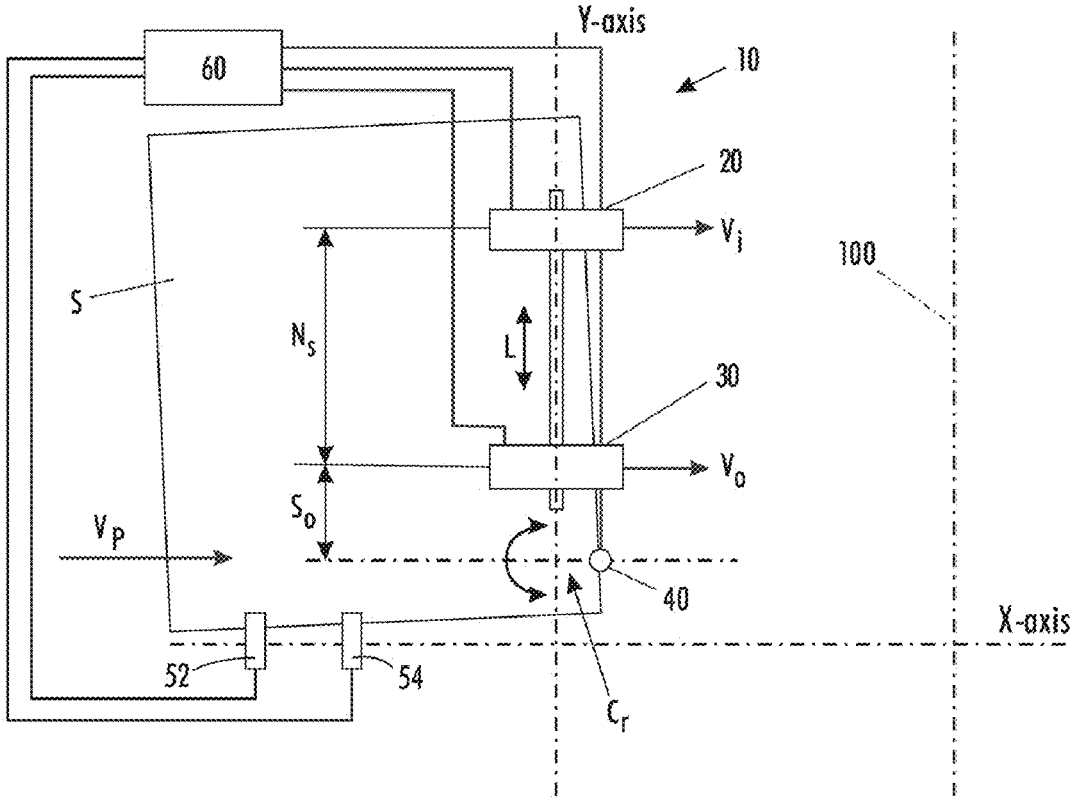
FIG. 1 is a partially schematic plan view of a system for registering the leading edge of a substrate media in a media handling assembly in accordance with an aspect of the disclosed technologies.

Describing now in further detail these exemplary embodiments with reference to the Figures, as described above the accurate sheet leading edge registration system and method are typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, a "media handling assembly" refers to one or more devices used for handling and/or transporting substrate media, including feeding, printing, finishing, registration and transport systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of moving, transporting and/or handling a substrate media. The process direction is a flow path the substrate media moves in during the process. A "cross-process direction" is perpendicular to the process direction and generally extends parallel to the web of the substrate media.

FIG. 1 depicts a partially schematic plan view of a system for registering the leading edge of a sheet handled in a printing system. It should be noted that the partially schematic drawings herein are not to scale. In FIG. 1, arrow P represents the primary direction of flow of the sheet S, which corresponds to the process direction, from an upstream location toward a downstream location. In this way, the sheet generally travels across a pair of nip assemblies 20, 30, together having a central axis 25 extending in a lateral direction L. The diameter or width of the individual drive or idler rolls can be varied as necessary for the particular application of the presently disclosed technologies. That central nip assembly axis 25 being coincident with the Y-axis as shown. Perpendicular to the Y-axis is the process direction, which extends along and parallel to the X-axis as shown. The system 10 includes a leading edge sensor 40 that is preferably positioned close to the nip assemblies 20, 30, as shown, but need not be positioned between the nips. Also, while additional leading edge sensors can be used, they are not necessary according to an aspect of the disclosed technologies. In accordance with an aspect of the disclosed technologies herein, the sheet skew correction will be accomplished by using a sheet center of rotation $C_r$ that is not located in the lateral center of the process direction or equidistant from both nip assemblies 20, 30. In particular, the sheet center of rotation $C_r$ preferably shares the same lateral position along the Y-axis as does the leading edge sensor 40.

Additionally, provided are lateral edge sensors 52, 54. Such sensors 52, 54 can be used to detect the orientation of the sheet as it approaches the nip assemblies 20, 30. While two sensors 52, 54 are shown, it should be understood that fewer or greater numbers of sensors could be used, depending on the type of sensor, the desired accuracy of measurement and redundancy needed or preferred. For example, a pressure or optical sensor could be used to detect when the lateral edge of the sheet passes over each individual sensor. Additionally, the sensors can be positioned further upstream or closer to the registration and de-skew area as necessary. It should be appreciated that any sheet sensing system can be used to detect the position and/or other characteristics of the substrate media in accordance with the disclosed technologies. By measuring the sheet lateral position at the sensors 52, 54 and knowing the spacing of the sensors 52, 54, skew of the sheet S relative to the nip assemblies 20, 30 and the datum 100 can be calculated, as is known in the art. Alternatively, a similar skew orientation of the sheet S can be detected by other sensor systems, disposed upstream of the nips 20, 30. For example, a pair of point sensors, similar to leading edge sensors 52, 54, or one or more array sensors capable of measuring skew can alternatively be provided.

The lateral position of the leading edge sensor 40, relative to the nip assemblies 20, 30, is used for calculating the skew correction. Thus, the distance $S_O$ represents the distance along the Y-axis from the leading edge sensor 40 to the nearest nip 30. If the leading edge sensor is located between the two nips 20, 30, then the value of $S_O$ would be negative. Also, the distance $N_S$ represents the distance along the Y-axis between the two nips 20, 30. The sheet velocity in the process direction is represented by $V_P$, while the velocities at the inboard nip 20 and the outboard nip 30 are represented by $V_i$ and $V_o$, respectively. A differential angular velocity is imparted to each of driven wheels in the nips 20, 30 with a motor and encoder(s) as is disclosed in the prior art, in order to temporarily change $V_i$ and $V_o$ to correct the detected skew. A differential drive system (not shown) is generally included which drives the nips 20, 30 at different speeds to impart movement to the handled sheet, particularly a rotational velocity for a brief period.

The position of the leading edge sensor 40, relative to the process direction, coincident with the X-axis, is generally in close proximity to the nips 20, 30 used for adjusting/correcting the detected skew. The sensor 40 detects the presence of a sheet S, starting when a point along the leading edge crosses the sensor 40. Accordingly, the time when the leading edge crosses over the sensor 40 is generally associated with the arrival of that sheet S to that position or point in the process. By placing the sensor 40 downstream relative to the nips 20, 30, the arrival at the position of the sensor 40 in the process direction can also be associated with the point where the sheet S is at least partially engaged by the nips 20, 30. Also, once the presence of the sheet S is detected, the nips 20, 30 only have a limited time of engagement with that sheet S in which to manipulate and/or adjust its position. Thus, while it is desirable to place the sensor 40 as close as possible in the process direction to the nips 20, 30, such a sensor could be positioned closer or further from the nips 20, 30 as desired for a particular application. Also, the sensor 40 could potentially be positioned on the upstream side of the nips 20, 30, with actual engagement of the sheet S in the nips 20, 30 being assumed or estimated immediately thereafter.

Figure 2:
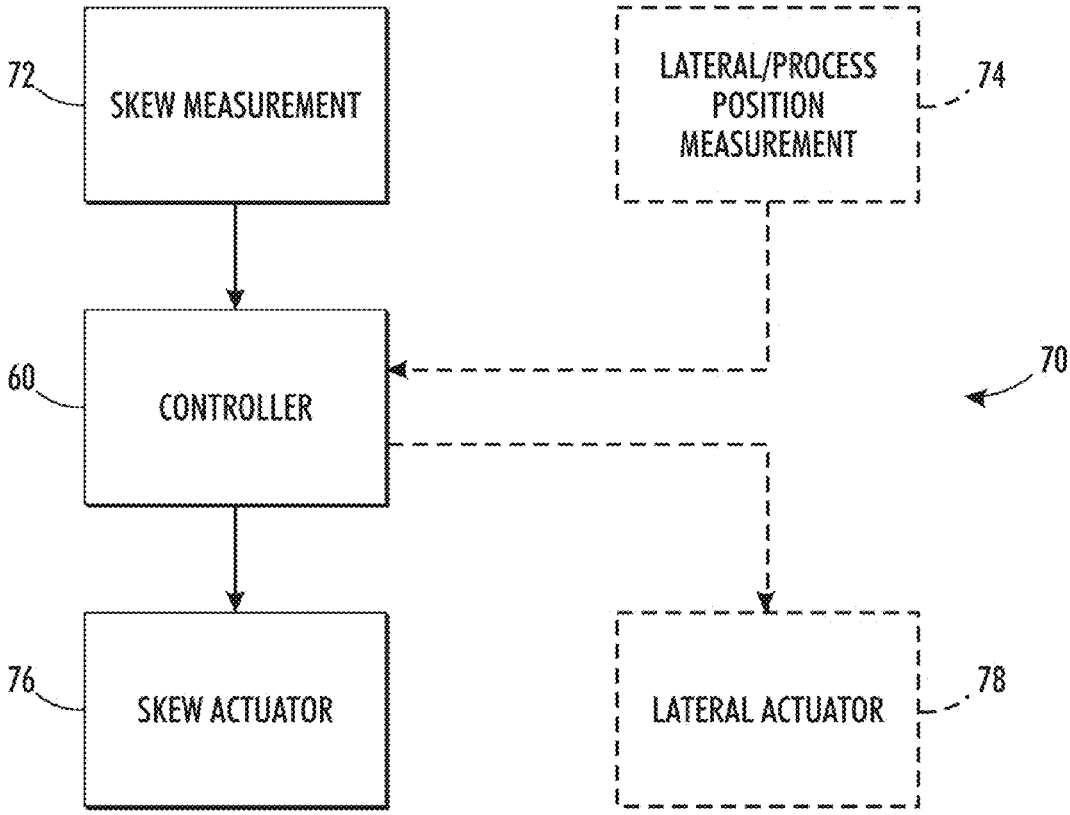
FIG. 2 is a schematic block diagram of a skew registration control method in accordance with an aspect of the disclosed technologies.

A controller 60 is used to receive sheet information from lateral edge sensors 52, 54, leading edge sensor 40 and any other available input that can provide useful information regarding the sheet(s) being handled in the system. The controller 60 can include one or more processing devices capable of individually or collectively receiving signals from input devices, outputting signals to control devices and processing those signals in accordance with a rules-based set of instructions. The controller 60 can then transmit signals to one or more actuation systems, such as a lateral actuator or a skew actuator 76 as shown in FIG. 2. A differential drive system is an example of a skew actuator in accordance with the disclosed technologies that will impart a skew velocity to the sheet with a center of rotation having a y-coordinate, along the Y-axis that is the same as the y-coordinate of sensor 40. Thus, based on the orientation of the sheet input into the controller, a "skew velocity profile" is calculated to eliminate the detected skew, while maintaining the relative position of the initially measured sheet leading edge at process speeds. A skew velocity profile includes a temporary change in the velocities at each nip 20, 30, which is executed by the controller 60 in order to effect the desired sheet rotation prior to or at the time the sheet S arrives at the datum 100. Using the illustrated geometric representation and variables, as well as considering Vp the velocity vector running parallel to the X-axis and through the leading edge sensor 40, the nip velocities $V_i$, $V_o$ for the calculated skew velocity profile can be represented as follows:

$$V_i = Vp + \delta V_i \quad (1);$$

and $$V_o = Vp + \delta V_o \quad (2),$$

where $\delta V_i$ and $\delta V_o$ represent the target change in the respective nip velocities needed to correct the measured skew, relative to the process speed Vp. Accordingly, the skew velocity profile $V_{Skew}$, which is traditionally defined as the difference between the temporary target values of $V_i$ and $V_o$, can be represented as follows:

$$V_{Skew} = \delta V_i - \delta V_o \quad (3).$$

As the change in velocities of $\delta V_i$ and $\delta V_o$ are calculated such that the y-coordinate of the center of rotation $C_r$ is the same as the y-coordinate of the leading edge sensor 40, the ratio of the velocity changes can be represented as follows:

$$(\delta V_o / \delta V_i) = S_O / (S_O + N_S) \quad (4).$$

Combining equations (3) and (4), and using $\alpha = S_O / N_S$ to solve for each change in nip velocity yields the following:

$$\delta V_i = (1+\alpha) V_{Skew} \quad (5);$$

and $$\delta V_o = \alpha V_{Skew} \quad (6).$$

Using formulas (5) and (6), in conjunction with a calculated temporary skew velocity $V_{Skew}$ needed to eliminate the skew in sheet S, will rotate the sheet about a center of rotation $C_R$ having a y-coordinate equal to the leading edge sensor 40 and deliver the leading edge of sheet S without error.

FIG. 2 shows a schematic block diagram of a skew registration control method used in accordance with an embodiment of the disclosed technologies. The accurate sheet leading edge registration method of the skew control block 70 commences upon the measurement of skew in the sheet S. The controller 60 is provided with a skew measurement 72, such as from lateral edge sensors 52, 54 disposed upstream from the nips 20, 30. Alternatively, such skew measurement 72 could be received by the controller from downstream sensors, such as the leading edge sensors 40, 42 shown in FIG. 3. Additionally, the lateral edge sensors 52, 54 can provide controller 60 with a lateral and/or process position measurement 74. Upon arrival of sheet S at the sensor 40, which also corresponds to the sheet being engaged by the nips 20, 30, the controller 60 can act to correct the measured skew and/or lateral positioning error(s). Accordingly, the skew actuator 76 will be activated upon receiving a signal from the controller 60. The skew actuator 76 corresponds to the differential drive system discussed above for imparting a skew velocity to the sheet S. In addition to skew correction, the skew actuator 76 can perform process timing corrections. Also, the lateral actuator 78 can similarly be activated if lateral adjustment is required. The lateral actuator 78 would correspond to any device or system for additionally adjusting the lateral position of the sheet. It should be understood that such skew and lateral adjustment can occur in any order or can occur at or near the same time. Further still, by providing additional downstream sensors (not shown) measuring skew and/or lateral position, a closed-loop feedback can be provided to controller 60 in order to make continuous adjustments to the skew and/or lateral position while the sheet remains engaged by the nips 20, 30.

Figure 3:
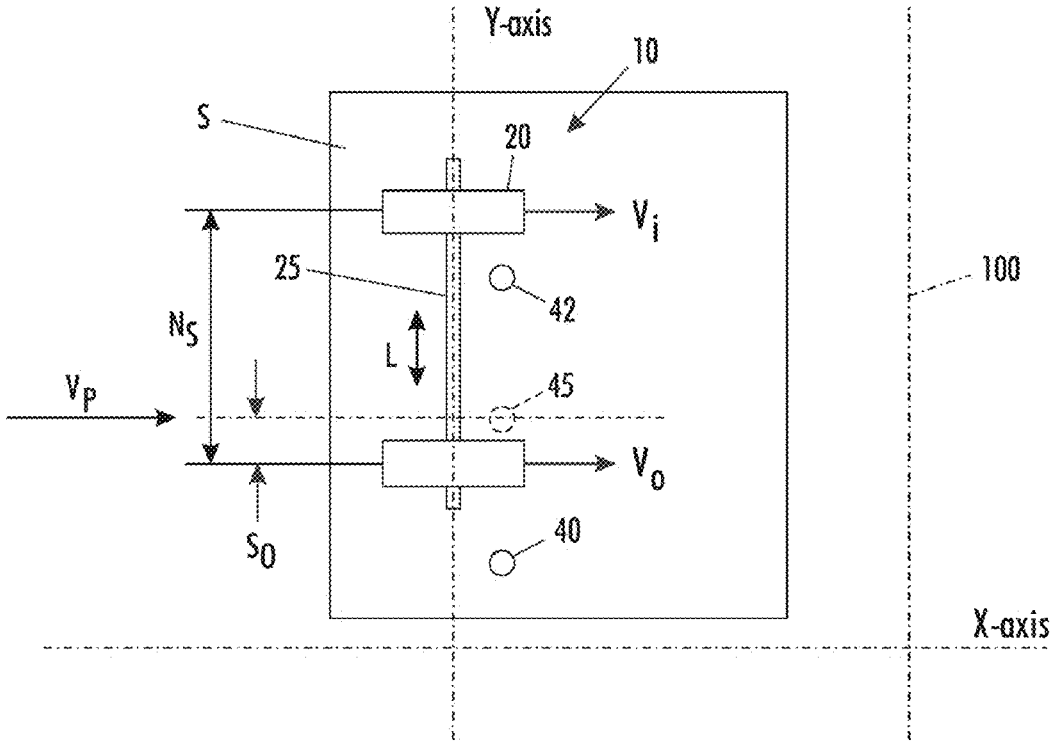
FIG. 3 is a partially schematic plan view of an alternative system for registering the leading edge of a substrate media in a media handling assembly in accordance with an aspect of the disclosed technologies.

FIG. 3 depicts a partially schematic plan view of a similar apparatus to that shown in FIG. 1, without illustrating the included controller 60, lateral edge sensors 52, 54 or the connections between the controller 60 and the various elements shown in FIG. 1. In this illustration, the sheet registration system 10 has already acted upon the sheet S and removed the skew, well before reaching the datum 100. At this point, $V_i$ and $V_o$ can both be returned to equal the process speed $V_P$ and $V_{Skew}$ can be returned to zero. It should be understood, however, that such correction can be achieved as late as the point at which the sheet S leading edge arrives at datum 100.

Figure 4:
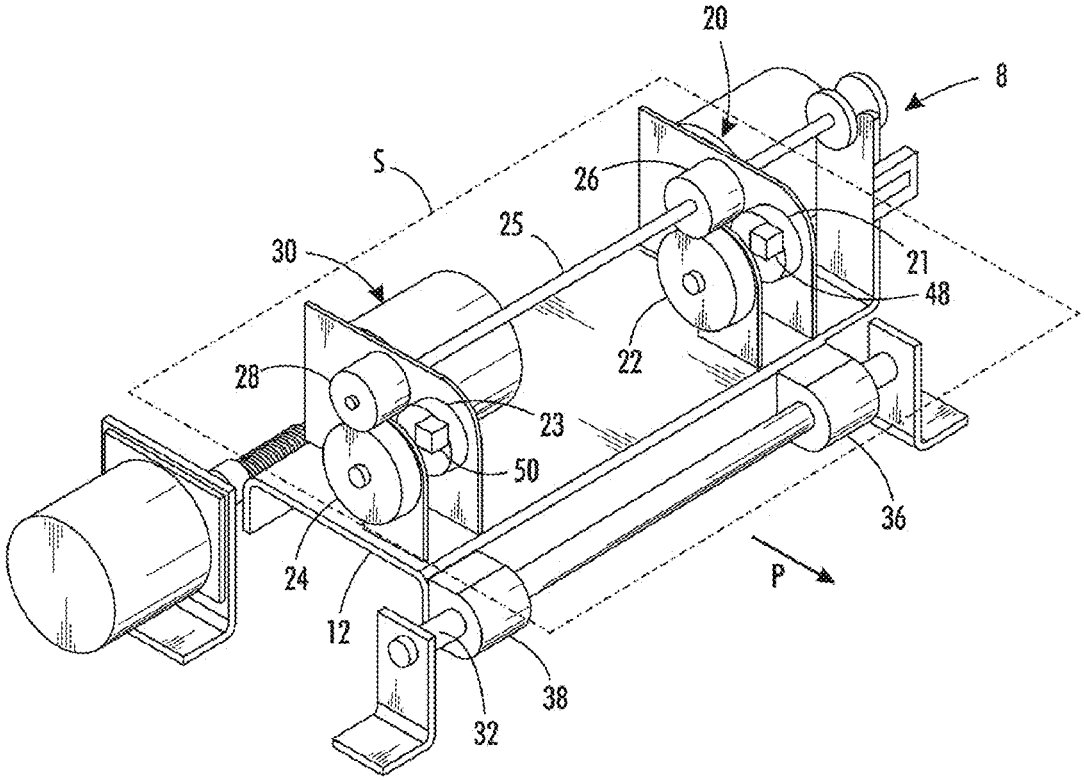
FIG. 4 PRIOR ART
FIG. 4 is an isometric view of a prior art sheet registration system.
Figure 5:
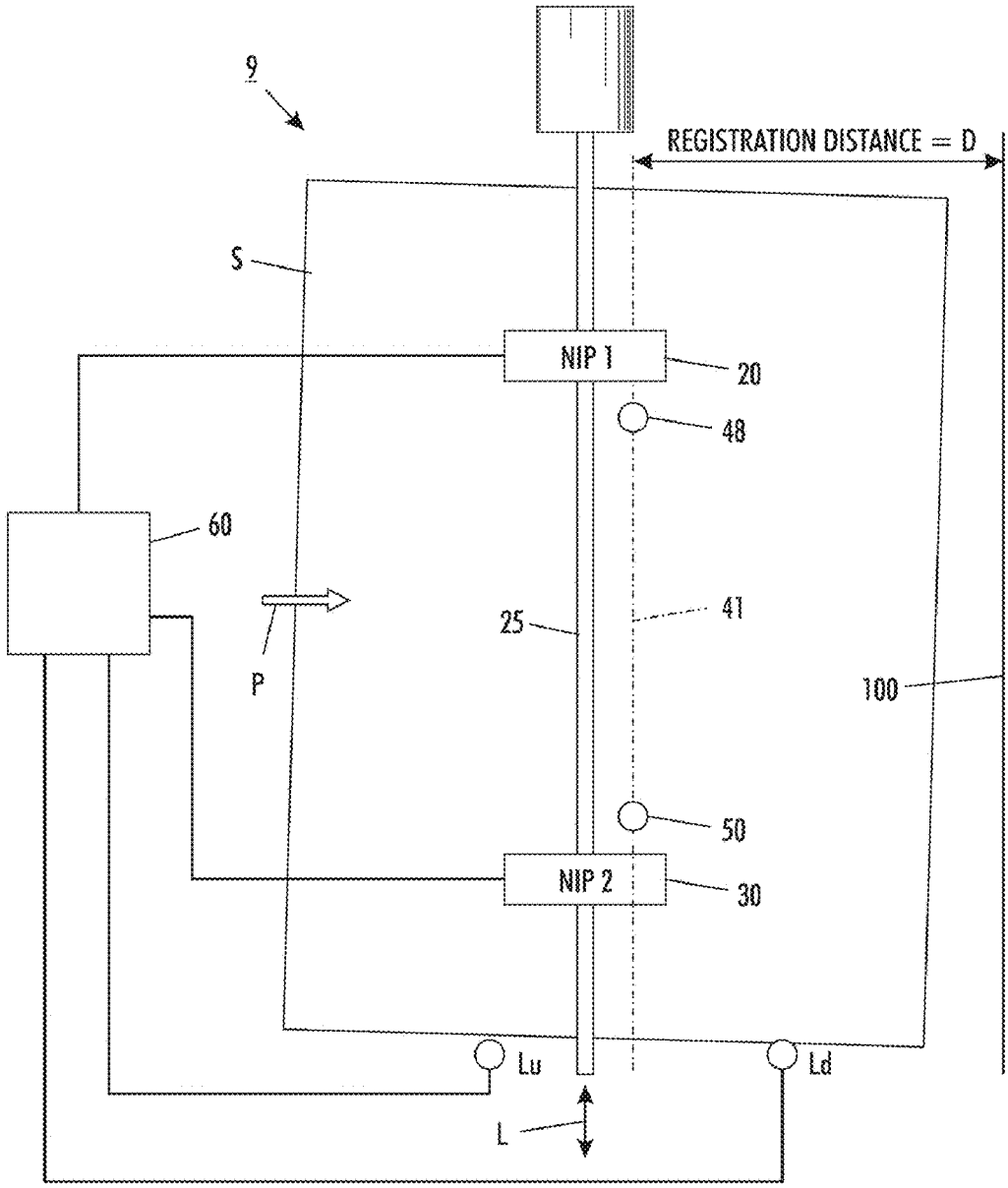
FIG. 5 PRIOR ART
FIG. 5 is a plan view of another prior art sheet registration system.

Additionally, further correction of cross-process positioning can also occur once the sheet S is engaged by the nip assemblies 20, 30, through the use of other known techniques in this regard. Such cross-process correction can occur any time prior to arrival at the datum 100. For example as shown in FIG. 4, the nip assemblies can be mounted on a laterally translatable carriage 12, with guides 32, 36 mounted on a shaft 32 extending in the lateral direction L. The carriage 12 carries, in a fixed configuration, the nip assemblies 20, 30 and a leading edge sensor, since the relative position of these elements should remain fixed. Alternatively, other known lateral translation techniques could be used.

FIG. 3 illustrates an alternative embodiment including more than one leading edge sensor 40, 42. The additional sensor 42 in this embodiment is positioned centrally between the two nips 20, 30 and in a similar position along the X-axis as sensor 40. As discussed above with regard to the position of sensor 40 along the process direction, the same applies to any additional sensors, such as sensor 42. Also, further alternative embodiments can position that additional leading edge sensor 42 almost anywhere lateral to the first sensor 40. In fact, the two sensors 40, 42 can be reposition as desired, preferably spaced laterally from one another. Also, as a further alternative more than one additional sensor could be included. The use of more than one leading edge sensor provides a hybrid configuration that can center the sheet rotation about a point having the same y-coordinate as any one of the provided sensors 40, 42. For example, if due to skew, sensor 42 detected the leading edge of the sheet S before sensor 40, the y-coordinate of sensor 42 could be used for rotation of the sheet S, as described above.

Additionally, the same configuration of sensors 40, 42 shown in FIG. 3 can be used to calculate a virtual sensor position 45, the y-coordinate of which can be used for sheet rotation. It should be noted that in the configuration shown, the value of $S_O$ would be negative, as applied in the formulas above. Also as applied to the above formulas, if the y-coordinate of sensor 40 from the embodiment of FIG. 1 or virtual sensor 45 from the embodiment of FIG. 3 were the same as the y-coordinate of one of the nips 20, 30, then the value of $S_O$ would be zero. Additionally, when a sheet S is skewed the leading edge will not arrive at the virtual sensor position 45 at the same time as the first real sensor 40, 42 that detected the sheet. Thus, the additional time it took the sheet S to reach the virtual sensor position 45 will have to be compensated for when calculating $V_{Skew}$, requiring the overall sheet to be temporarily moved a little faster than process speed in order to timely and accurately deliver the leading edge to the registration datum 100.

Further, process positioning and timing can also be adjusted while the sheet S is engaged in the nip assemblies 20, 30 by varying $V_P$ accordingly. During any adjustment of skew, cross-process or process positioning or timing, any downstream nips are preferably opened to allow the sheet S to be adjusted more freely.

Often media handling assembly, and particularly printing systems, include more than one module or station. Accordingly, more than one registration system 10 as disclosed herein can be included in an overall media handling assembly. Further, it should be understood that in a modular system or a system that includes more than one registration system 10, in accordance with the disclosed technologies herein, could detect sheet position and relay that information to a central processor for controlling registration, including skew in the overall media handling assembly. Thus, if the skew or sheet position is too large for registration system 10 to correct, then correction can be achieved with the use one or more subsequent downstream registration systems 10, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for registering the leading edge of a sheet moved substantially in a process direction along a path in a media handling assembly, a lateral direction extending perpendicular to the process direction, the apparatus comprising:

a first nip assembly and a second nip assembly, the first and second nip assemblies being spaced apart from one another;

a first sheet leading edge sensor, the first sheet leading edge sensor detecting an arrival of a leading edge of a sheet at a point in the process direction, wherein the arrival is associated with engagement of the first and second nip assemblies with the sheet, the first sheet leading edge sensor being disposed laterally between opposed lateral edges of the sheet;

a controller imparting a rotational skew velocity to the sheet using the first and second nip assemblies, a center of rotation of the skew velocity being offset laterally from a center of the sheet leading edge, wherein the skew velocity center of rotation is coincident with a lateral position of the first sheet leading edge sensor; and a differential drive system operatively connected to the first nip assembly, the second nip assembly and the controller, the differential drive system inducing the rotational skew velocity to the sheet.

2. The apparatus of claim 1, wherein the first sheet leading edge sensor is spaced away from at least one of the first and second nip assemblies by a sensor offset distance, wherein the offset distance extends laterally.

3. The apparatus of claim 1, further comprising:

a cross-process sheet adjustment assembly for laterally moving said sheet while engaged by the first and second nip assemblies.

4. An apparatus for registering the leading edge of a sheet moved substantially in a process direction along a path in a media handling assembly, a lateral direction extending perpendicular to the process direction, the apparatus comprising:

a first nip assembly and a second nip assembly, the first and second nip assemblies being spaced apart from one another;

a first sheet leading edge sensor, the first sheet leading edge sensor detecting an arrival of a leading edge of a sheet at a point in the process direction, wherein the arrival is associated with engagement of the first and second nip assemblies with the sheet, the first sheet leading edge sensor being disposed laterally between opposed lateral edges of the sheet, wherein the first sheet leading edge sensor is spaced away from at least one of the first and second nip assemblies by a sensor offset distance, wherein the offset distance extends laterally; and a controller imparting a rotational skew velocity to the sheet using the first and second nip assemblies, a center of rotation of the skew velocity being offset laterally from a center of the sheet leading edge, wherein the rotational skew velocity is generated by changing a sheet driving velocity of each of the first and second nip assemblies, the sheet driving velocities calculated in accordance with:

$$\delta V_i=(1+\alpha)V_{Skew}; \text{ and}$$

$$\delta V_o=\alpha V_{Skew},$$

wherein $\delta V_i$ represents the change in sheet drive velocity of the first nip assembly, $\delta V_o$ represents the change in sheet drive velocity of the second nip assembly, $V_{Skew}$ represents a rotational velocity imparted on the sheet, and $\alpha$ represents a ratio of a lateral distance between the first sheet leading edge sensor and the nearest of the first and second nip assemblies, over a lateral nip assembly spacing.

5. A method of registering the leading edge of a sheet moved substantially in a process direction along a path in a media handling assembly, a lateral direction extending perpendicular to the process direction, the method comprising:

providing a first nip assembly and a second nip assembly, the first and second nip assemblies being spaced apart from one another;

providing a first sheet leading edge sensor, the first leading edge sensor detecting an arrival of a sheet at a point in the process direction, wherein the arrival is associated with engagement of the first and second nip assemblies with the sheet, the first sheet leading edge sensor being disposed laterally between opposed lateral edges of the sheet upon arrival;

providing a differential drive system operatively connected to the first nip assembly, the second nip assembly and a controller, the differential drive system inducing a rotational skew velocity to the sheet; and imparting the rotational skew velocity to the sheet using the first and second nip assemblies, a center of rotation of the skew velocity being offset laterally from a center of the sheet leading edge, wherein the skew velocity center of rotation is coincident with a lateral position of the first sheet leading edge sensor.

6. The method of claim 5, wherein the first leading edge sensor is spaced away from at least one of the first and second nip assemblies by a sensor offset distance, wherein the offset distance extends laterally.

7. The method of claim 5, further comprising:

providing a cross-process sheet adjustment assembly for laterally moving said sheet.

8. A method of registering the leading edge of a sheet moved substantially in a process direction along a path in a media handling assembly, a lateral direction extending perpendicular to the process direction, the method comprising:

providing a first nip assembly and a second nip assembly, the first and second nip assemblies being spaced apart from one another;

providing a first sheet leading edge sensor, the first leading edge sensor detecting an arrival of a sheet at a point in the process direction, wherein the arrival is associated with engagement of the first and second nip assemblies with the sheet, the first sheet leading edge sensor being disposed laterally between opposed lateral edges of the sheet upon arrival; and imparting a rotational skew velocity to the sheet using the first and second nip assemblies, a center of rotation of the skew velocity being offset laterally from a center of the sheet leading edge, wherein the first leading edge sensor is spaced away from at least one of the first and second nip assemblies by a sensor offset distance, wherein the offset distance extends laterally, wherein the rotational skew velocity is generated by changing a sheet driving velocity of each of the first and second nip assemblies, the sheet driving velocities calculated in accordance with:

$$\delta V_i=(1+\alpha)V_{Skew}; \text{ and}$$

$$\delta V_o=\alpha V_{Skew},$$

wherein $\delta V_i$ represents the change in sheet drive velocity of the first nip assembly, $\delta V_o$ represents the change in sheet drive velocity of the second nip assembly, $V_{Skew}$ represents a rotational velocity imparted on the sheet, and $\alpha$ represents a ratio of a lateral distance between the first sheet leading edge sensor and the nearest of the first and second nip assemblies, over a lateral nip assembly spacing.

* * * * *